US006264582B1

(12) United States Patent
Remes

(10) Patent No.: US 6,264,582 B1
(45) Date of Patent: Jul. 24, 2001

(54) METHOD FOR TRAINING OF MUSCLES

(76) Inventor: Arto Remes, Rouskurinne 22, FIN-70800, Kuopio (FI)

( * ) Notice: Subject to any disclaimer, the term of this patent is extended or adjusted under 35 U.S.C. 154(b) by 0 days.

(21) Appl. No.: 09/440,862

(22) Filed: Nov. 16, 1999

(30) Foreign Application Priority Data

Nov. 17, 1998 (FI) ..... 982489

(51) Int. Cl.[7] ..... A63B 69/00
(52) U.S. Cl. ..... 482/8; 600/546; 600/595
(58) Field of Search ..... 482/1–9, 900–902; 600/546, 587, 595

(56) References Cited

U.S. PATENT DOCUMENTS 5,474,083 * 12/1995 Church et al. ..... 600/546
5,538,486 * 7/1996 France et al. ..... 482/8
6,063,046 * 5/2000 Allum ..... 600/595

* cited by examiner

*Primary Examiner*—Glenn E. Richman
(74) *Attorney, Agent, or Firm*—Pillsbury Winthrop LLP

(57) ABSTRACT

A method includes designing a personal training and treatment program based on assessing a condition and a functional state of at least one muscle of a user. The method includes programming a measurement probe and apparatus, placed the measurement probe adjacent the muscle when the user is training, measuring and recording electrical activity of the muscle using the measurement probe when the user is training, tracking the condition and functional state of the muscle while the electrical activity of the muscle is recorded, and providing feedback to prompt the user to contract the muscle at a predetermined level for a predetermined amount of time based on tracking the condition and functional state of the muscle of the user. Feedback is repeatedly providing when the user is training.

6 Claims, 6 Drawing Sheets

IMPROVEMENT

Figure 1A:
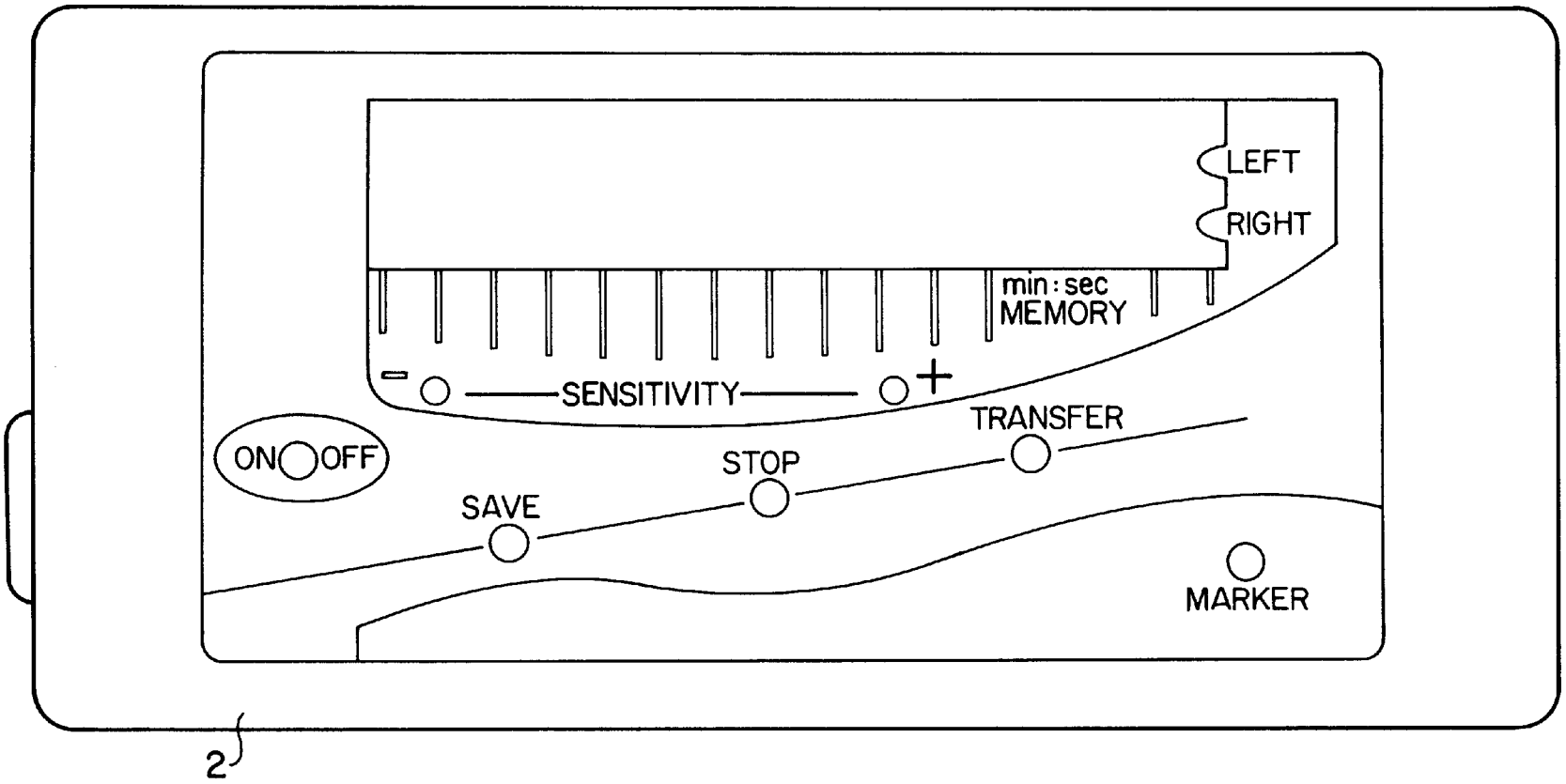

| | LEFT | RIGHT | LR MEAN |
|---|---|---|---|
| FAVE(abs)uV | 2 | 2 | 2 |
| FPEAK(abs)V | -1 | -1 | -2 |
| FAVE(rel)% | 9 | 11 | 10 |
| FPEAK(rel)% | -3 | -4 | -7 |

METHOD FOR TRAINING OF MUSCLES

The object of the invention is a method for the training of skeletal muscles, in which method a measurement probe is placed on or in the immediate vicinity of one or several muscles, the electrical activity of one or several muscles is measured by a measurement probe and muscle function and condition are followed via the muscle electrical activity.

Presently, measurement probes are used to follow muscle electrical activity and thereby muscle function. While carrying out muscle exercises it is very important that the person doing the exercises gets feedback as clearly as possible already during the exercises. Especially when exercising such muscles about which the function may be difficult to follow or difficult to sense, rapid feedback is central for success of treatment and training. There are several such muscles and muscle groups, including the pelvic floor muscles.

Weakening or injury of the pelvic floor muscles can cause injury incontinence. Urinary incontinence is a condition in which the involuntary leakage of urine becomes a social and hygiene problem. Incontinence is found in about a fifth of persons aged 15–75. In the working age group incontinence is, however, primarily a problem in women. In women suffering from incontinence the problem causes social withdrawal work absenteeism, limitations or activities, marital problems and anxiety. The most common of the urinary disturbances is stress incontinence, in which urine leaks during physical exercise or while straining. Incontinence caused by weakened pelvic floor muscles can be treated surgically, but surgery can be avoided with many non-surgical therapies.

Many exercises for different muscles are carried out under controlled conditions, such as in the clinic or laboratory. This requires health care personnel and precise schedules. Furthermore, the patient must arrive at a specific time. There are also training devices that can be used at home, but the patient does not usually get reliable information about or feed back from the exercise while exercising at home.

The most important treatment and rehabilitation procedure for pelvic floor muscles is the increasing of the strength, speed and function of the pelvic floor muscles through active muscle training. For this purpose different equipment has been developed by which these muscle can be trained in the clinic, laboratory or other similar places. It is important that the incontinence problem gets properly treated by doing simple muscle exercises and repeatedly for a sufficient length of time for a given training session. That the urinary incontinence problem can be treated at home and that exercises can be done in a familiar environment at the patient's convenience is also extremely important.

The goal of the invention is achieved by a method whose characteristics are presented in the claims.

In the method according to the invention auditory feedback is linked to the measurement probe. The auditory feedback enables the user to concentrate on muscle activity and gives feedback during the training session. By taking advantage of the biofeedback equipment in the invention, certain physiological conditions and their changes, of which the patient would otherwise remain unaware, can be detected, followed and altered. In this way the patient can learn to recognize the activity of certain muscle groups and to control their function. The feedback develops self guidance mechanisms at the same time. For auditory feedback, any sound considered appropriate for the purpose can be used.

In the preferred application of the invention is the use of voice as a guidance for auditory feedback. In principle, virtually anybody can closely follow the verbally given instructions, which allows treatment and training to be carried out in the intended fashion to improve the condition of target muscles. Another advantage is that in addition to instructions, words of encouragement can be added, motivating the patient and improving compliance with treatment and training.

The invention can be advantageously applied so that health care personnel can control the measurement probe. The microprocessor in the probe allows the care giver programs the desired treatment and training program. This allows the treatment and training exercises to be individually tailored to the needs of each patient. The probe has a memory unit and calendar for following the programmed protocols. Information from the training sessions that are carried out are saved in the memory for review during a follow-up visit to the clinic. It is also possible to take advantage of various other methods of data transfer for sending training session information to the clinic, and similarly, to allow updating or changing of the treatment and training programs.

In a favorable adaptation of a method compatible with the invention, the method is used for the treatment of urinary incontinence. For this purpose the measurement probe is placed into the vagina, the electrical activity of the pelvic floor muscles is measured and the pelvic floor muscles undergo training. The activity of pelvic floor muscles is hard for the patient to recognize without reliable equipment and measuring probes. In the recognition of the activity of these muscles and in their exercising it is important to get feedback during the entire training session in order to achieve a training effect. When using a method compatible with the invention, feedback about muscle activity is given at all times, allowing active exercising of these muscles in a programmed and pre-selected way.

The invention can be favorably applied to give visual feed back to allow recognition of muscle activity. A monitor or equivalent is used for following treatment and training sessions and for evaluating muscle condition. This kind of visual equipment can form part of the treatment and training equipment. The equipment can be used at home or health care personnel can use it in the clinic, laboratory or other similar places.

Figure 1B:
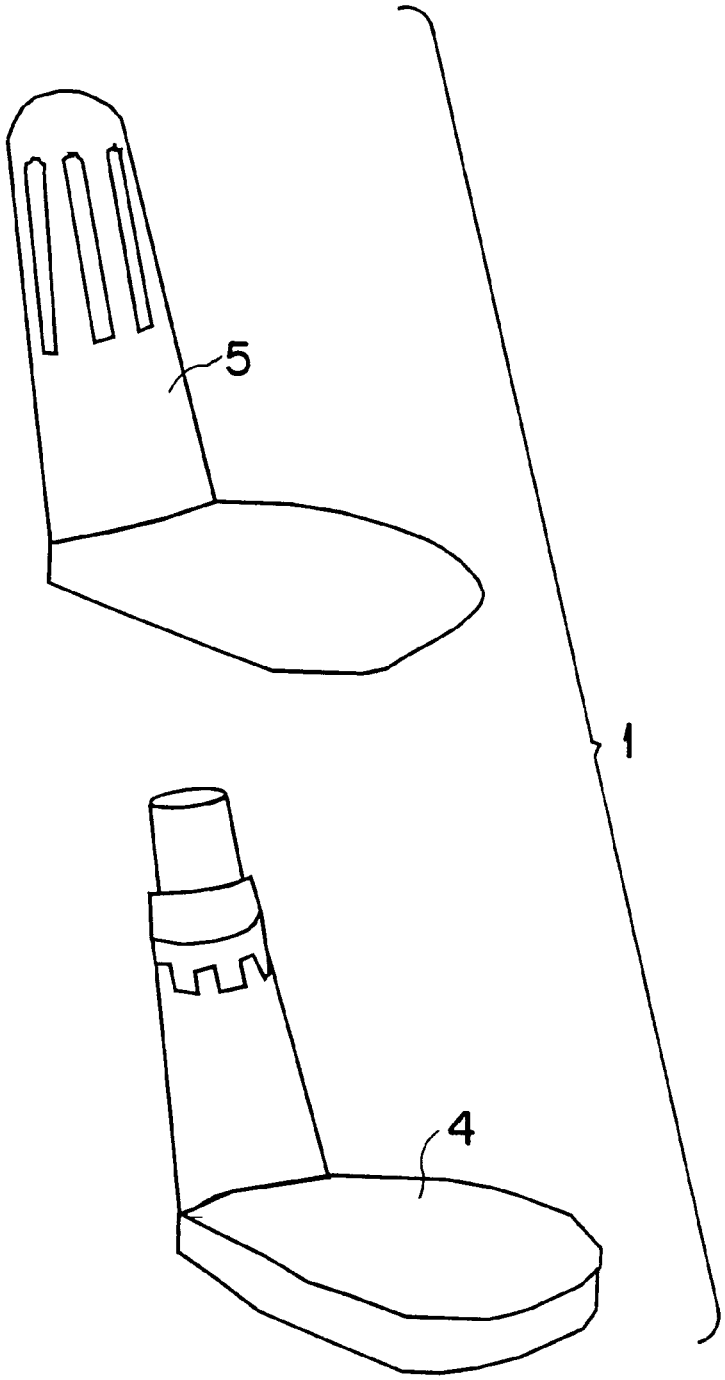
Figure 1C:
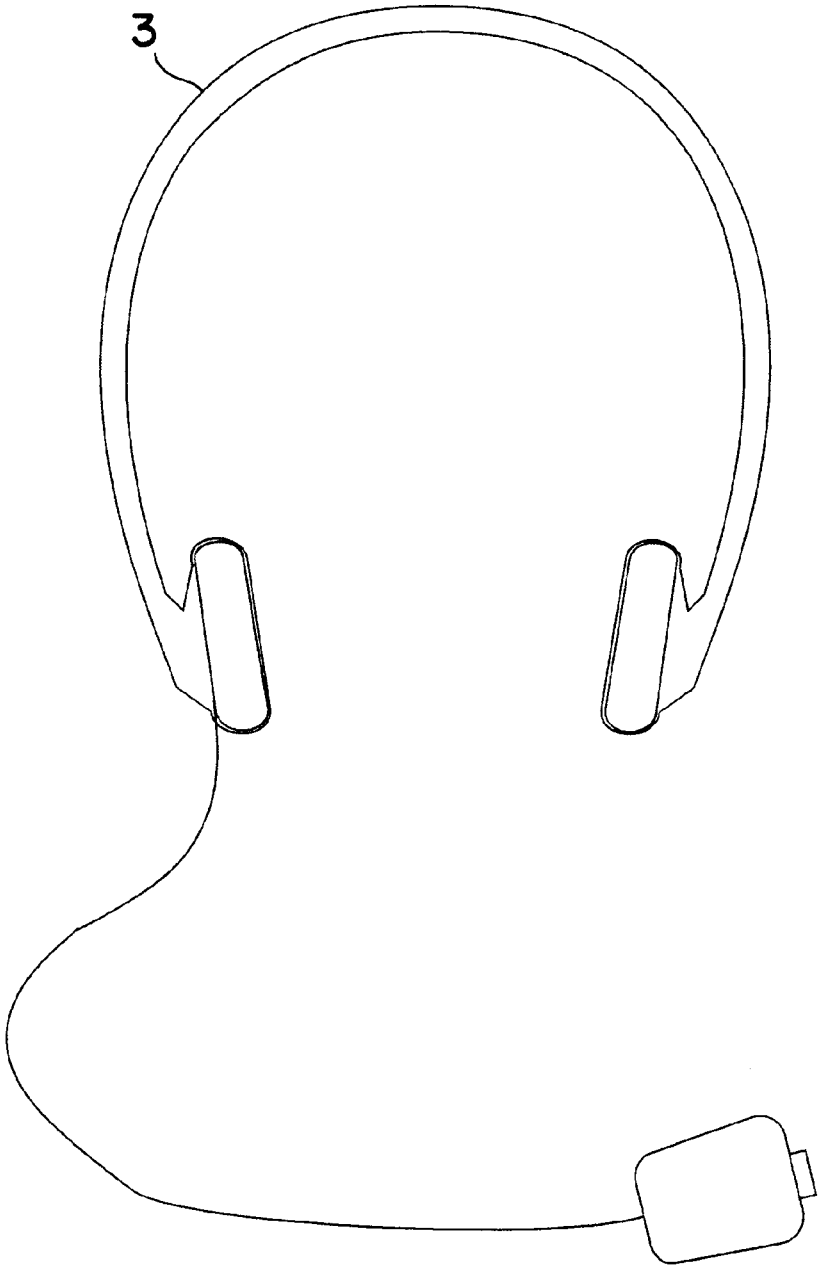
Figure 2:
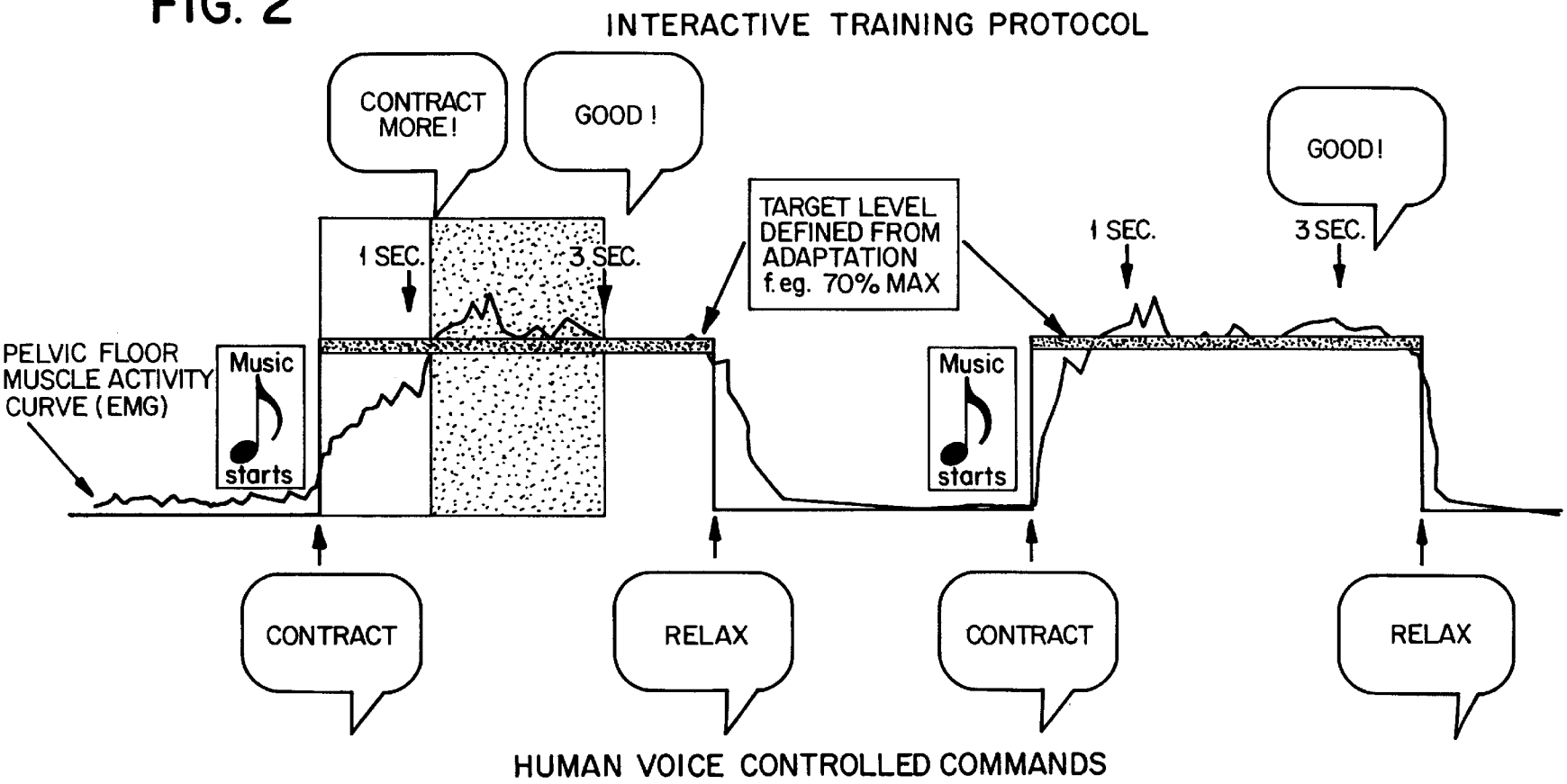
Figure 3A:
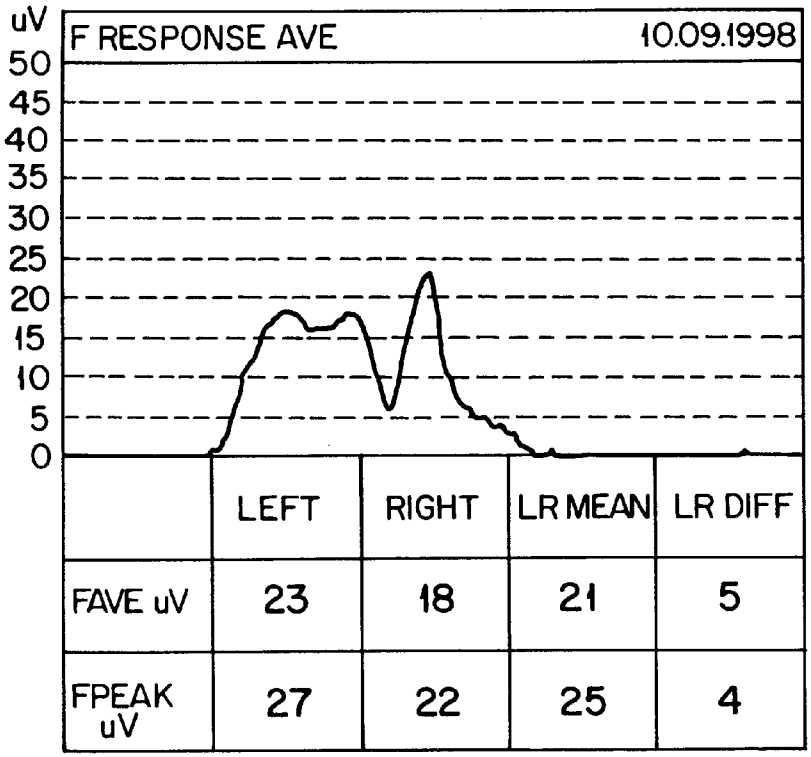
Figure 3B:
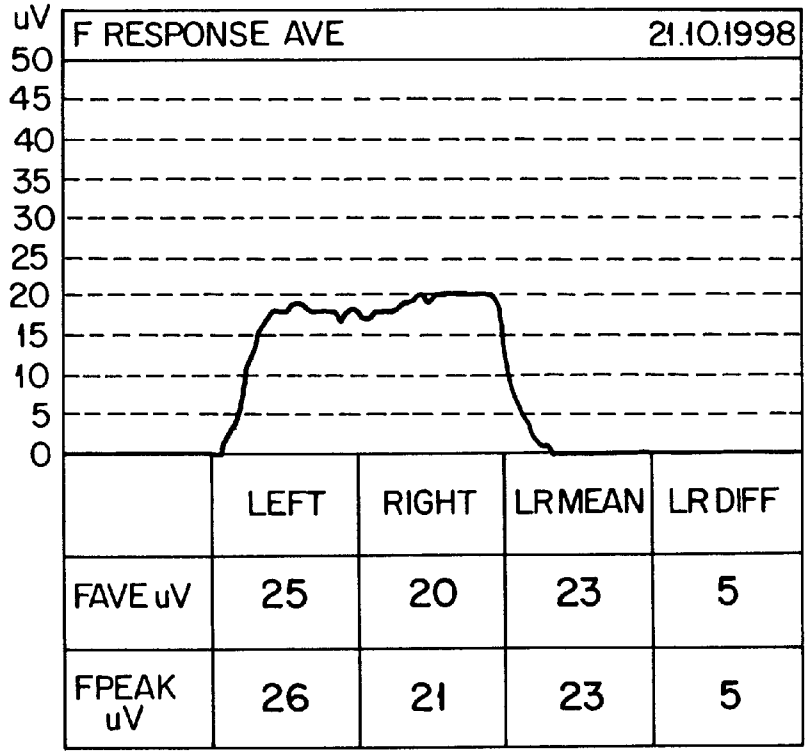
Figures 3C, 3D:
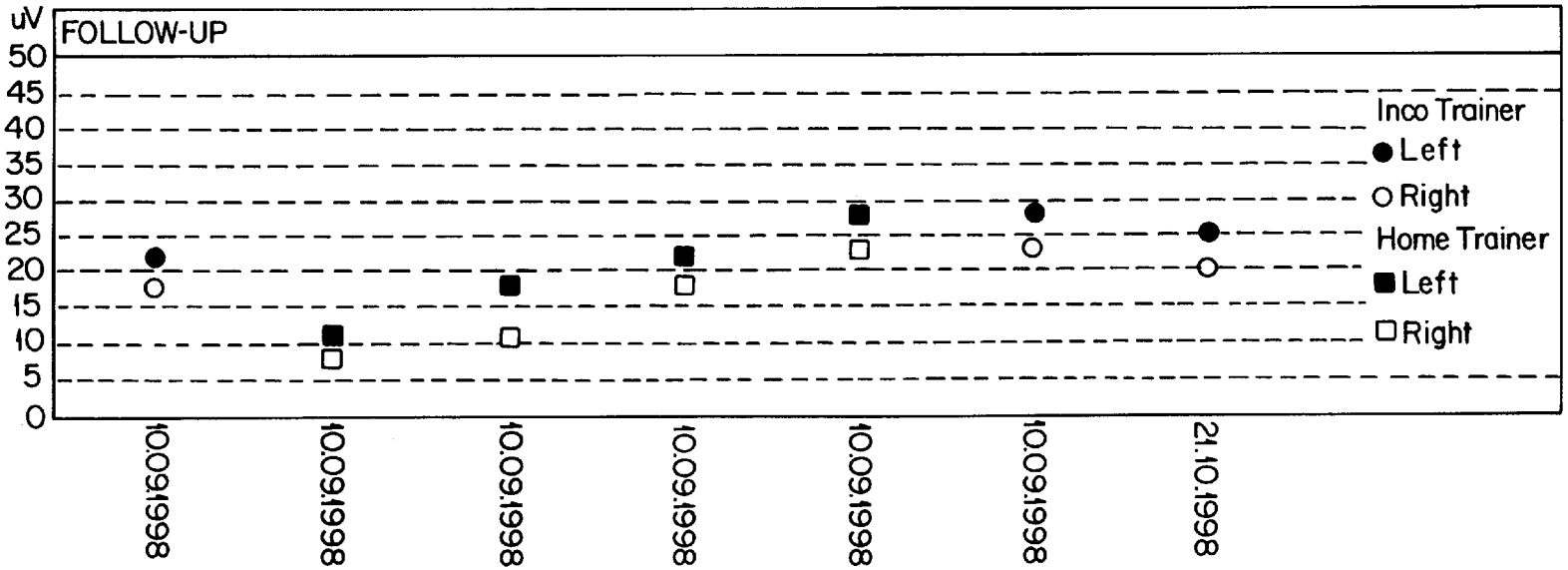

In the following the invention will be described in more detail by referring to the figures, in which:

FIG. 1 illustrates an application of the equipment for the treatment of incontinence, FIG. 2 graphically displays a training program, and FIG. 3 illustrates a follow-up report for the training sessions carried out by a patient.

The equipment displayed in FIG. 1 consists of an EMG measuring unit 2 and a measurement probe 1. Also included are an optical cable connecting the EMG measuring unit and measurement probe and headphones 3, which are connected to the measurement probe and through which treatment and training instructions can be heard. A microprocessor is built into the measurement probe. The measurement probe consists of two parts: the probe 5 and the stem 4. The probe can be detached from the stem. The measurement probe's probe unit is sterilized and is meant for a single patient. The probe attachment has the electrodes and grounds needed for measurement on the sides. A microprocessor located in the probe stem has room for the training program, a second processor or card and memory sufficient for recording and following training for desired periods, e.g. one or several months.

When using equipment such as in FIG. 1, the pelvic floor muscle condition and functional state is first assessed. The measurement is based on the electrical activity of the muscle, i.e., the EMG activity. The measurement is carried out by placing a measurement probe such as that pictured in FIG. 1 into the vagina. The left- and right-sided muscle activity is then measured separately or simultaneously from electrodes placed in different sites on the probe. After the baseline measurements are carried out, a personal training program is designed for the patient. Using the EMG measurement unit, the training and treatment program is saved in the memory of the measurement probe shown in FIG. 1. The patient can take the measurement probe and carry out the exercises at home.

The EMG recordings from a training session and the instructions and feedback given to the patient during the session are shown in FIG. 2. Feedback is immediately given to the patient throughout the exercises at specific intervals. The program saved in the memory of the measurement probe, and the levels that the patient must try to reach during the exercises are displayed in the figure on the thick line 1. At the beginning of the exercise session the EMG activity is near zero. At this point relaxing music or some other relaxing sound is heard. The programmed voice then requests the patient to begin the training session and to contract a specific muscle or muscles. If the muscle activity does not reach the desired level, the program requests that the intensity of contraction be increased. When the desired level is achieved, positive feedback is given. After the first exercise is completed the program asks the patient to relax. At this point relaxing music is played. The program then requests the patient to start the next exercise and to begin contraction. When a sufficient level of contraction is maintained for a predetermined length of time, the program gives positive feedback. At the end of patient is asked to relax. In this way a sufficient number of exercises are carried out as defined by the treatment and training program.

Successful treatment of stress incontinence requires that individualized pelvic floor muscles exercises are properly carried out for a sufficient length of time. When performing the training exercises the training and treatment events are recorded in the memory of the measurement probe. The measurement probe thus functions as an automatic diary. Before the next treatment and training session the recorded data is unloaded to a PC. Reports showing the level achieved and the progress made are produced from the data recorded during the treatment and exercise sessions. The patient's progress is followed in an individualized fashion e.g. monthly, and the training and treatment program is changed according to the patient's progress. The goal is to stress the muscles at an appropriate level throughout the training program. The intensity level is changed when advancing to the next treatment and training period.

In FIG. 3, results are displayed in different ways schematically and graphically. Results from the pelvic floor muscle exercises at daily and 10 day intervals show that with training, the strength of the pelvic floor muscles increases. With training, the urinary incontinence problem can be alleviated or even eliminated.

The invention is not limited to the advantageous applications presented here. The invention can also be applied to other muscles or muscle groups. Furthermore, methods compatible with the invention can vary within the framework of the ideas of the invention which are elaborated in the claims.

What is claimed is:

1. A method for training at least one muscle of a user, the method comprising:

assessing a condition and a functional state of the at least one muscle of the user;

after the condition and the functional state of the at least one muscle are assessed, designing a personal training and treatment program for the user;

programming a measurement probe and apparatus;

individually tailoring treatment protocols of the training and treatment program for the user;

saving the training and treatment program in a memory;

placing the measurement probe adjacent the at least one muscle when the user is training;

measuring and recording electrical activity of the at least one muscle using the measurement probe when the user is training;

tracking the condition and functional state of the at least one muscle while the electrical activity of the at least one muscle is recorded;

providing feedback to the user in the form of auditory guidance to help the user concentrate on the condition and the functional state of the at least one muscle, wherein the feedback prompts the user to contract the at least one muscle at a predetermined level for a predetermined amount of time based on tracking the condition and functional state of the at least one muscle of the user; and repeatedly providing said feedback when the user is training.

2. The method according to claim 1, in which the auditory guidance is in the form of speech.

3. The method according to claim 1, in which health care personnel control functions of the measurement probe.

4. The method according to claim 1, in which the measurement probe has the memory and a calendar for storing the training and treatment program.

5. The method according to claim 1, further comprising:

placing the measurement probe into the vagina of the user; and measuring electrical activity of a pelvic floor muscle of the user for treatment of urinary incontinence.

6. The method according to claim 1, in which visual feedback is used for increasing control of the functional state of the at least one muscle.

* * * * *